US007094982B2

(12) United States Patent
Liu

(10) Patent No.: US 7,094,982 B2
(45) Date of Patent: Aug. 22, 2006

(54) SWITCH DEVICE

(75) Inventor: Chin Sheng Liu, Taipei (TW)

(73) Assignee: Behavior Tech Computer Corp., Taipei (TW)

( * ) Notice: Subject to any disclaimer, the term of this patent is extended or adjusted under 35 U.S.C. 154(b) by 0 days.

(21) Appl. No.: 11/021,861

(22) Filed: Dec. 27, 2004

(65) Prior Publication Data

US 2006/0137964 A1 Jun. 29, 2006

(51) Int. Cl.
*H01H 19/00* (2006.01)
*H01H 19/14* (2006.01)

(52) U.S. Cl. ..... 200/336; 200/11 J; 200/564; 200/567; 200/568; 200/570

(58) Field of Classification Search ..... 200/331, 200/332, 336, 11 R, 11 E, 528, 529, 564, 200/568, 569, 572, 526, 11 J
See application file for complete search history.

(56) References Cited

U.S. PATENT DOCUMENTS 3,718,786 A * 2/1973 Fila ..... 200/419
4,066,857 A * 1/1978 Suska ..... 200/61.7
4,463,231 A * 7/1984 Cooper et al. ..... 200/528
5,227,595 A * 7/1993 Sorenson et al. ..... 200/11 J
5,901,835 A * 5/1999 Hung ..... 200/316
6,114,638 A * 9/2000 Naganuma et al. ..... 200/6 R
6,396,015 B1 * 5/2002 Ko ..... 200/529
6,867,379 B1 * 3/2005 Hayashi ..... 200/4
2004/0154910 A1 * 8/2004 Hayashi ..... 200/412

FOREIGN PATENT DOCUMENTS

JP 07288065 A * 10/1995

* cited by examiner

*Primary Examiner*—Elvin Enad
*Assistant Examiner*—Lheiren Mae A. Anglo

(57) ABSTRACT

A switch device includes a base member, a rotary mechanism and a vertical actuation mechanism. The rotary mechanism is received in the base member to move a present circular displacement while a hollow handle turning. The vertical actuation mechanism is received in the base member under the rotary mechanism to move a downward preset displacement in the vertical direction for touching button type switches underneath while the rotary mechanism moving.

4 Claims, 8 Drawing Sheets

SWITCH DEVICE

FIELD OF THE INVENTION

The present invention relates to a switch device and more particularly to a switch device, which is capable of being rotated at one end thereof and moving a displacement at another end thereof to touch a contact point of another switch.

BACKGROUND OF THE INVENTION

The conventional rotary switch is operated by means of rotational mechanism to allow two or more contact points being able to touch to each other for reaching a state of ON. Similarly, the conventional push type switch is operated to allow two or more contact points being able to touch to each other once the switch is pressed for reaching a state of ON. The preceding conventional switches are provided to perform contact points being able to electrically connect with each other.

SUMMARY OF THE INVENTION

An objective of the present invention is to provide a switch, which has a structure different from the preceding conventional switch and it allows the user to rotate an end of the switch in the circumferential direction and results in the switch moving a displacement at another end thereof to press contact points of other switches next to it.

In order to achieve the preceding objective, the switch device according to the present invention includes a base member, a rotary mechanism and a vertical actuation mechanism. The rotary mechanism, which is received in the base member, can be rotated a preset circular distance to urge the vertical actuation mechanism, which is received in the base member, to move a rectilinear displacement for touching contact points underneath.

BRIEF DESCRIPTION OF THE DRAWINGS

The detailed description and technical characteristics of the present invention are described together with the drawings as follows.

DETAILED DESCRIPTION OF THE INVENTION

Figure 1:
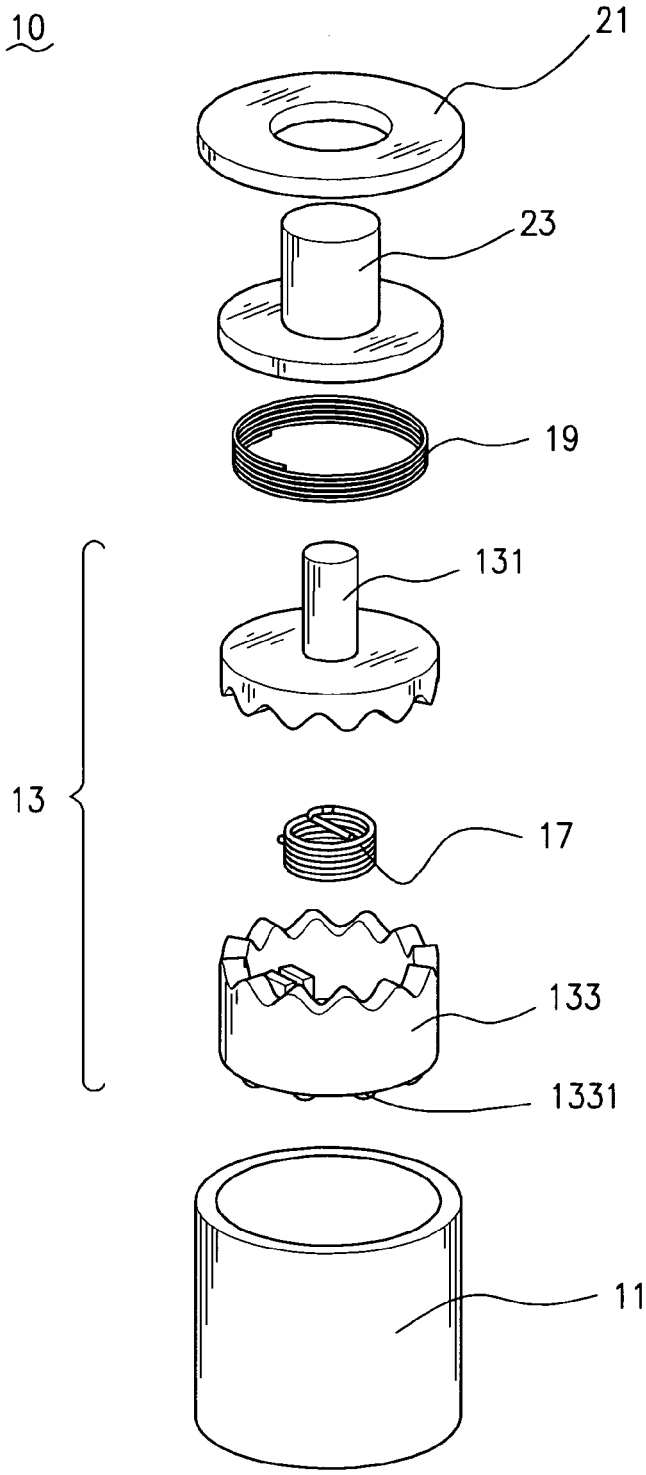
FIG. 1 is an exploded perspective view of the first embodiment of a switch according to the present invention being projected from top.
Figure 2:
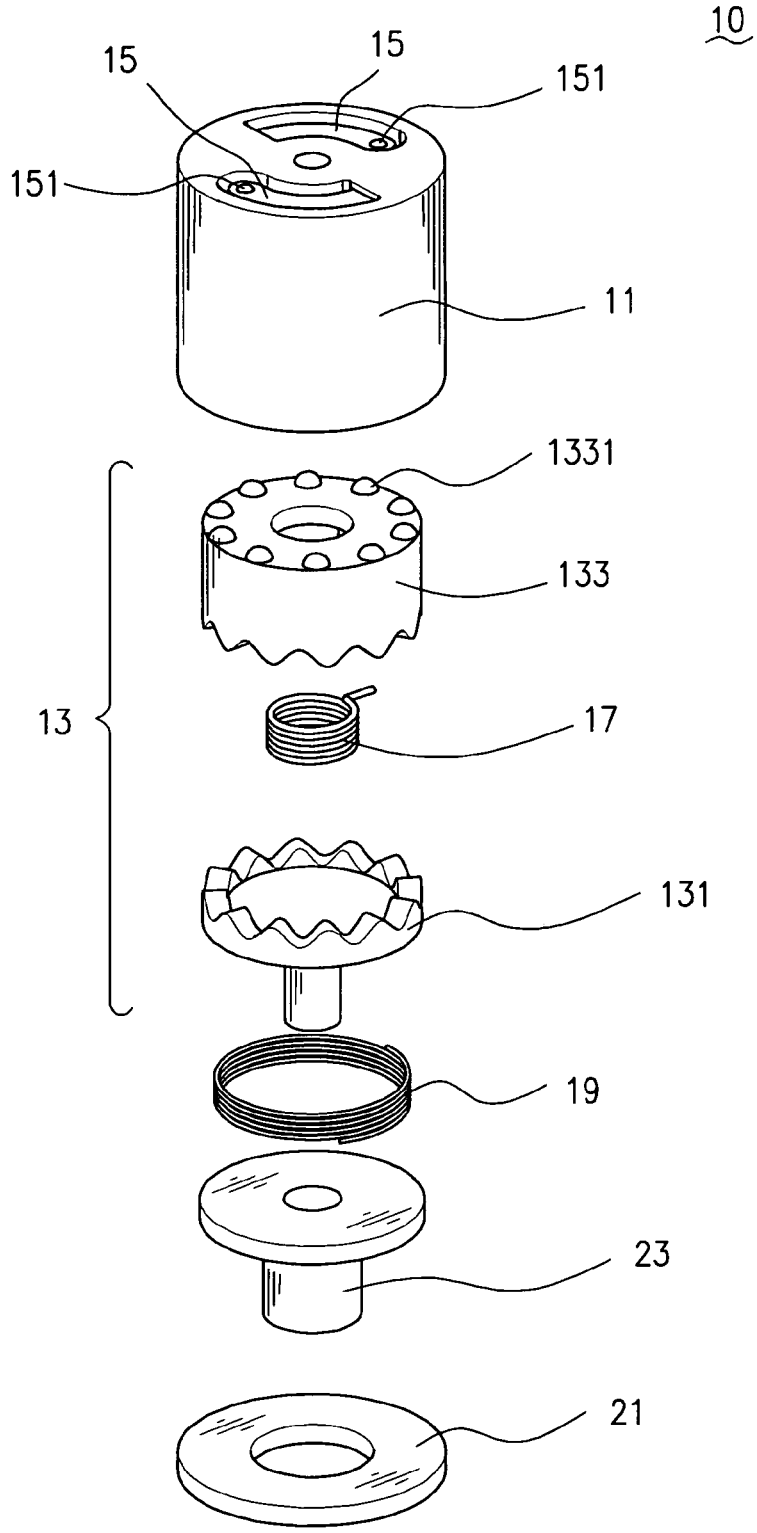
FIG. 2 is another exploded perspective view of the first embodiment of a switch according to the present invention being projected from bottom.

Referring to FIGS. 1 and 2, exploded perspective views of the first embodiment of a switch according to the present invention are illustrated. The switch device 10 comprises a base member 11, a rotary mechanism 13 and a vertical actuation mechanism 15. The rotary mechanism 13 and the vertical actuation mechanism 15 are received in the base member 11 respectively. While in use, the user turns the rotary mechanism 13 to move a preset circular displacement. The vertical actuation mechanism 15 is disposed under the rotary mechanism 15 and pressingly contacted with the rotary mechanism 13 during the rotary mechanism 13 moving. Thus, the vertical actuation mechanism 15 is urged to move a rectilinear displacement in the vertical direction. The rotary mechanism 13 is composed of a first ratchet wheel 131 and a second ratchet wheel 133. The first ratchet wheel 131 has central stem extending outward from the rear side thereof and the second ratchet wheel 133 has an axial hole and is provided with a plurality of semispherical shaped projections 1331 next to the circumferential edge of the rear side thereof. When the first ratchet wheel 131 rotates, the second ratchet wheel 133 is driven to rotate too due to the ratchet teeth on the first ratchet wheel 131 and the second ratchet wheel 133 meshing with each other. Hence, the projections 1331 can move the preset circular displacement synchronously with the second ratchet wheel 133. Further, the base member 11 is cylindrical and provides a central post extending from the bottom thereof to pass through the axial hole of the second ratchet wheel 133 such that the second ratchet wheel 133 can be placed on the bottom of the base member 11. In addition, the bottom of the base member 11 has two opposite long circular grooves along the circumferential periphery thereof. The vertical actuation mechanism 15 is composed of two elastic plates, which are placed at the bottom of the base member 11 corresponding to the circular grooves respectively and each of the elastic plates is provided with a ball shaped contact point 151. When the second ratchet wheel 133 rotates with the projections 1331 and displaces the preset circular displacement, the contact points 151 are pressingly touched by the moving projections 1331 such that the contact points 151 move a rectilinear displacement downward vertically. In this way, the contact points 151 are capable of touching other contact points underneath (not shown), which correspond to the contact points 151. The elastic plates can be made of sheet metal or resilient plastic plate.

In order to allow the rotary mechanism 13 being capable of moving back to the original position at moving the preset circular displacement, a torsion spring 17 is disposed at the bottom of the second ratchet wheel 133. It can be seen in FIGS. 3 and 4 that two rectangular shaped blocks are fixedly attached to the inner rear side and the inner wall side of the second ratchet wheel 133 in parallel such that a locating space is formed between the blocks. The top of the central post of the base member is provided with a locating groove. The torsion spring 17 has the two ends thereof being fixedly joined to the locating space of the second ratchet wheel 133 and the locating groove of the central post respectively. When the second ratchet wheel 133 is free from a rotational force, the resilient force of the torsion spring 17 pulls the second ratchet wheel 133 back to the original position. Referring to FIG. 4 in company with FIGS. 1 and 2 again, a hollow handle 23 provides a hollow part to fixedly joined to the central stem of the first ratchet wheel 131. A compression spring 19 is disposed between the cylindrical handle 23 and the first ratchet wheel 131 to surround the central stem of the first ratchet wheel 131. Once the first ratchet wheel 131 is free from the rotational force and the second ratchet wheel 133 moves back to the original position, the teeth of the both ratchet wheels 131, 133 being away from meshing together such that the first ratchet wheel 131 moves back to the original position against the resilient force of the spring 19.

Figure 3:
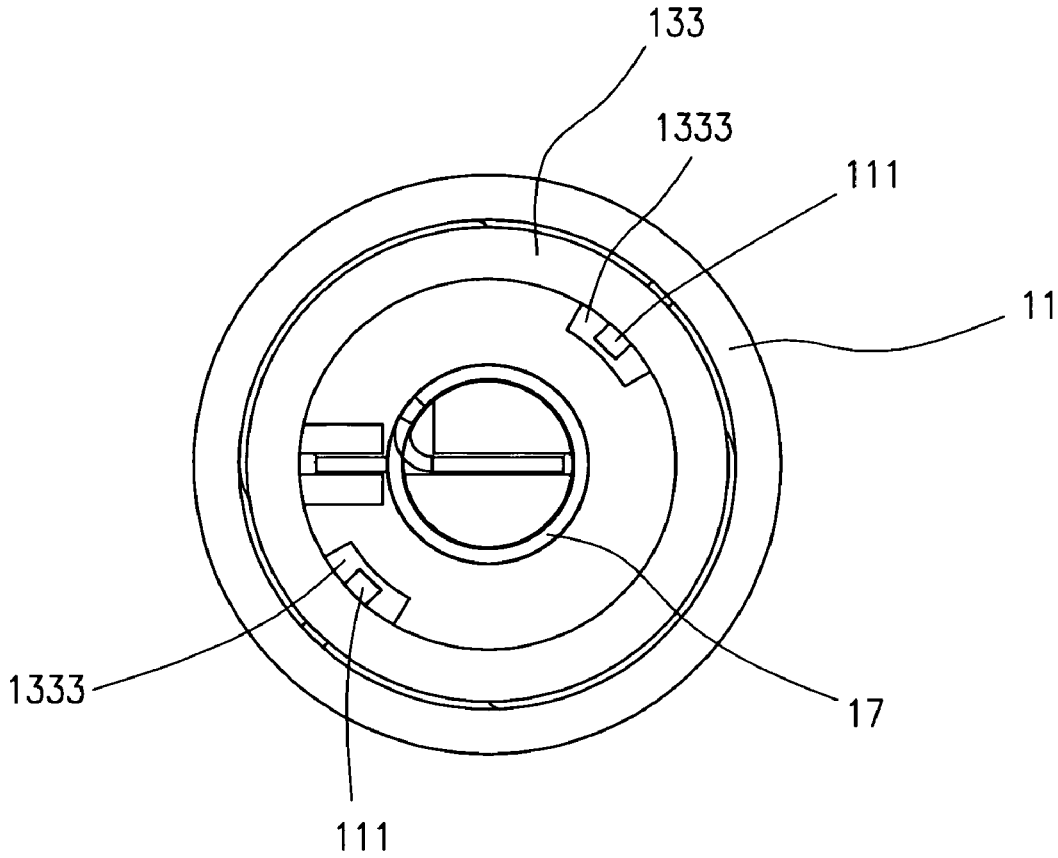
FIG. 3 is a top view of the first embodiment of a switch according to the present invention illustrating part of interior thereof.
Figure 4:
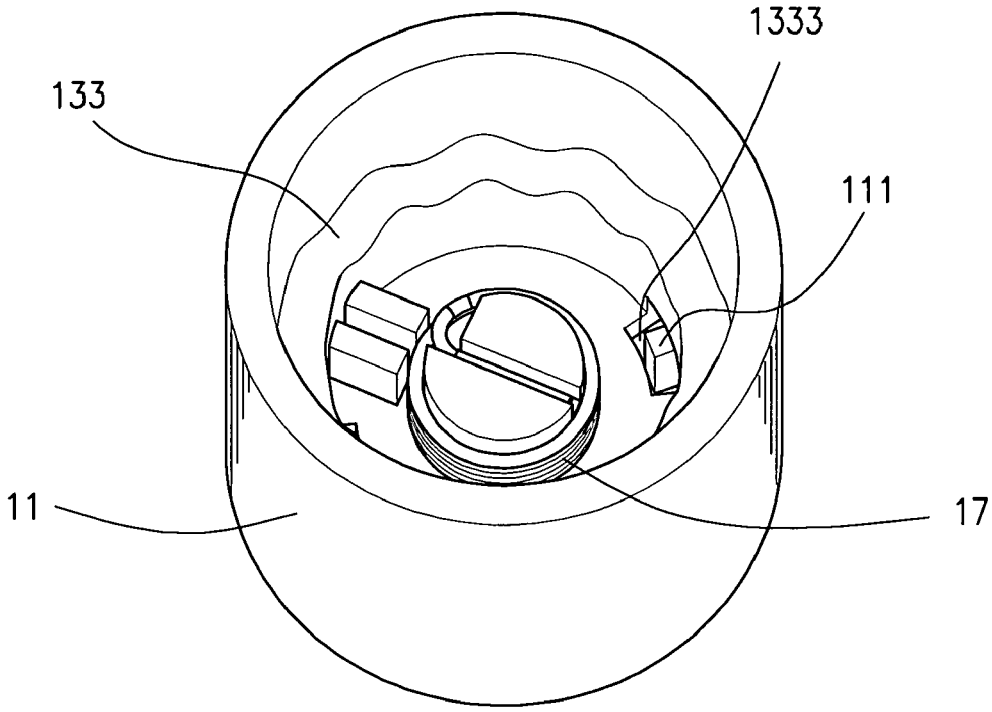
FIG. 4 is a perspective view illustrating part of the internal structure of the first embodiment of a switch according to the present invention.

Referring to FIG. 3, in order to limit the preset circular displacement done by the rotary mechanism 13, the second ratchet wheel 133 is provided with two opposite limit grooves 1333 at the rear side of the second ratchet wheel 133 and a locating rib 111 is provided at the inner wall surface of the base member 11 corresponding to the limit grooves 1333 respectively. When the second ratchet wheel 133 rotates, the side wall of the respective limit groove 1333 approaches the locating rib 111 gradually till being stopped by the locating rib 111 such that the second ratchet wheel 133 is restricted to rotate the preset circular displacement only.

Besides, the switch device 10 further includes a cover plate 21, which has a central hole too. The cover plate 21 is used for tightly closing an upper opening of the base member 11. The hollow handle 23 extends outward the cover plate 21 via the central hole. The hollow handle 23 further has a disk shaped bottom to enclose the compression spring 19 with the first ratchet wheel 131.

Figure 5:
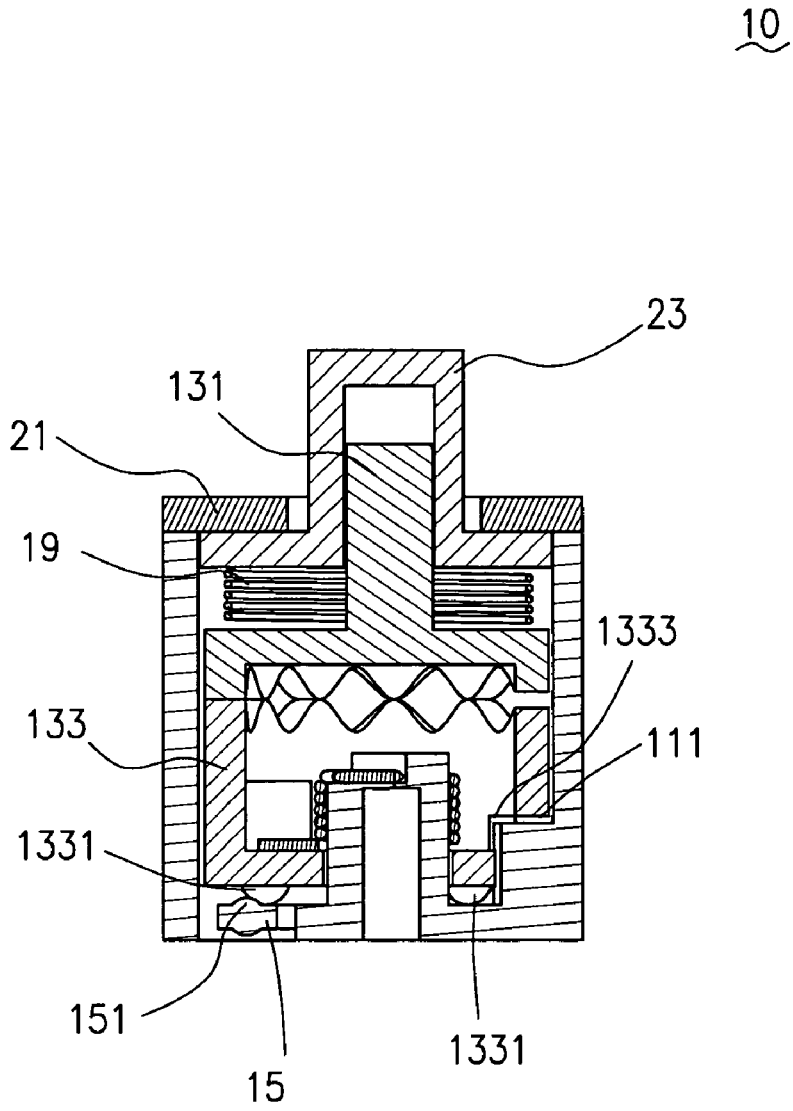
FIG. 5 is an assembled sectional view of the first embodiment of a switch according to the present invention.

Referring to FIG. 5, once the user rotates the hollow handle 23, the first ratchet wheel 131 is actuated to rotate and the second ratchet wheel 133 is driven by the first ratchet wheel 131. Meanwhile, the projections 1331 move to approach the vertical actuation mechanism 15 so that the contact point 151 can be pressed by the projections 1331 to produce the rectilinear displacement in the vertical direction for pressing button type switches 27*b*, 27*c* (shown in FIG. 6).

Figure 6:
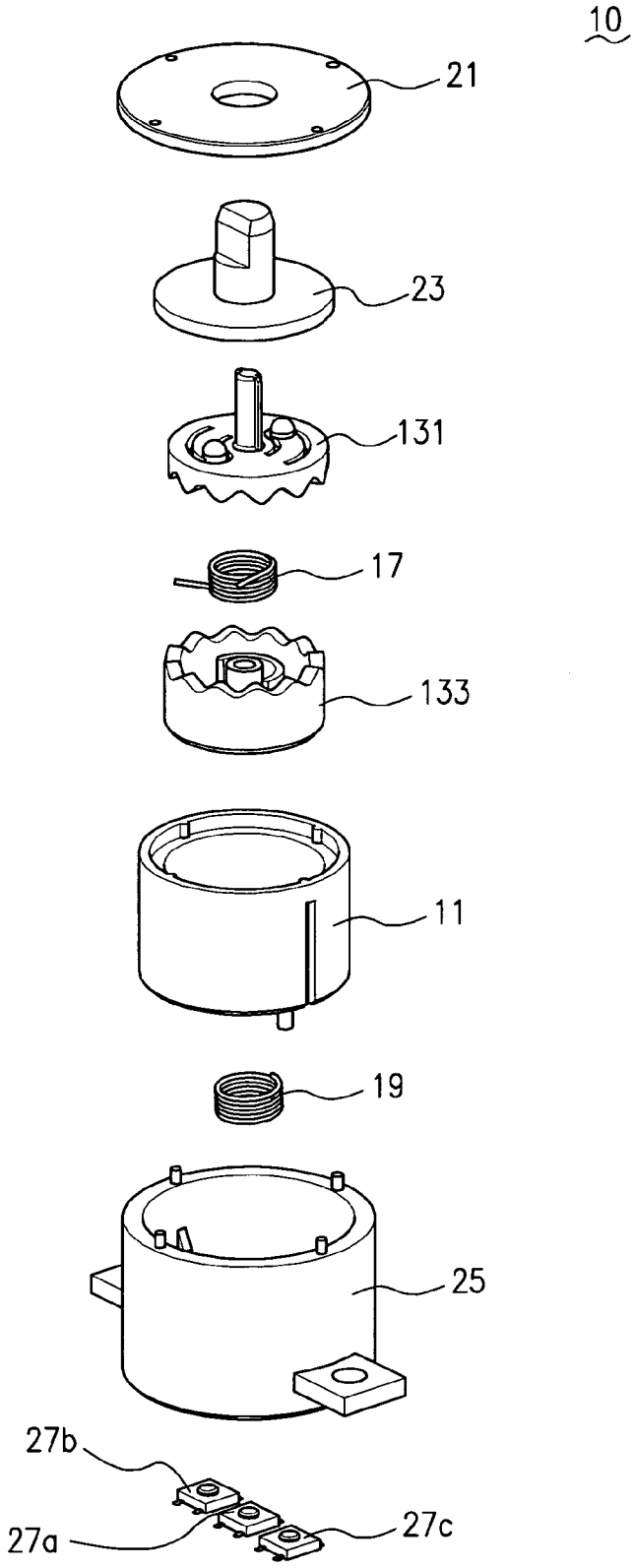
FIG. 6 is an exploded perspective view of the second embodiment of a switch according to the present invention being projected from top.
Figure 7:
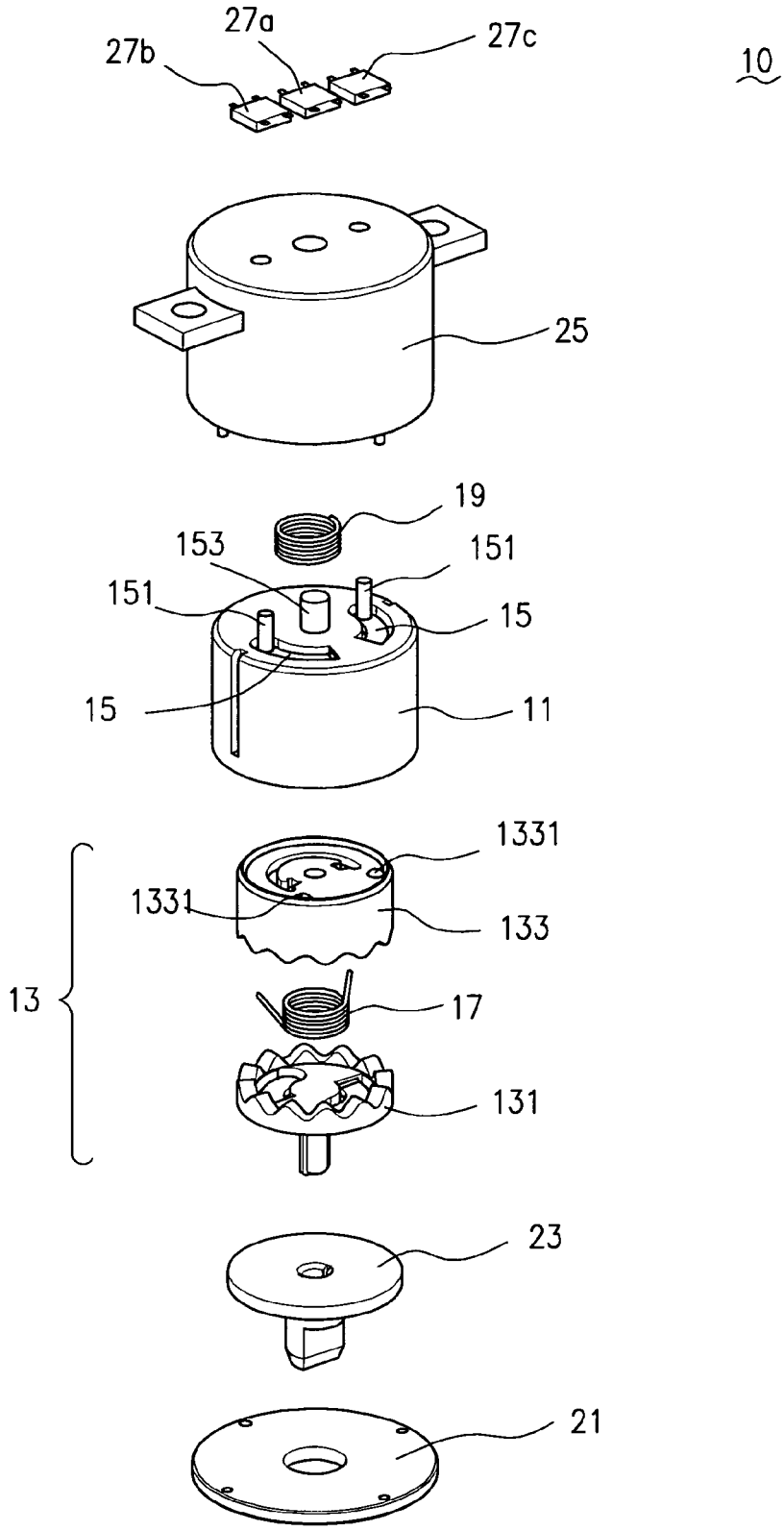
FIG. 7 is another exploded perspective view of the second embodiment of a switch according to the present invention being projected from bottom.

Referring to FIGS. 6 and 7, the second embodiment of a switch device according to the present invention is illustrated. The switch device 10 shown in FIG. 6 is capable of allowing the user to press down the hollow handle 23 and a first pressing post 153 disposed at the base member 11 can be actuated to move downward for touching the push type switch 27*a* in addition to being capable of providing the user to turn the hollow handle 23 for performing a function to touch the push type switches 27*b*, 27*c* as the first embodiment does. The switch device 10 of the second embodiment further provides an outer sleeve 25 for receiving other components. Meanwhile, the first pressing post 153 is provided at the center of the bottom of the base member 11 for passing through a central hole at the bottom of the outer sleeve 25. When the hollow handle 23 is pressed down directly in the vertical direction, the first pressing post 153 can move downward to press the push type switch 27*a*. The vertical actuation mechanism 15 provides two second pressing posts 151 extending outward the bottom of the base member 11 instead of the ball shaped contact points done in the first embodiment for passing through two opposite guide holes corresponding to the central hole at the bottom of outer sleeve 25. When the rotary mechanism 13 is in operation, the second pressing posts 151 are pressed to move downward a preset vertical displacement to touch the switches 27*b*, 27*c* respectively.

Figure 8:
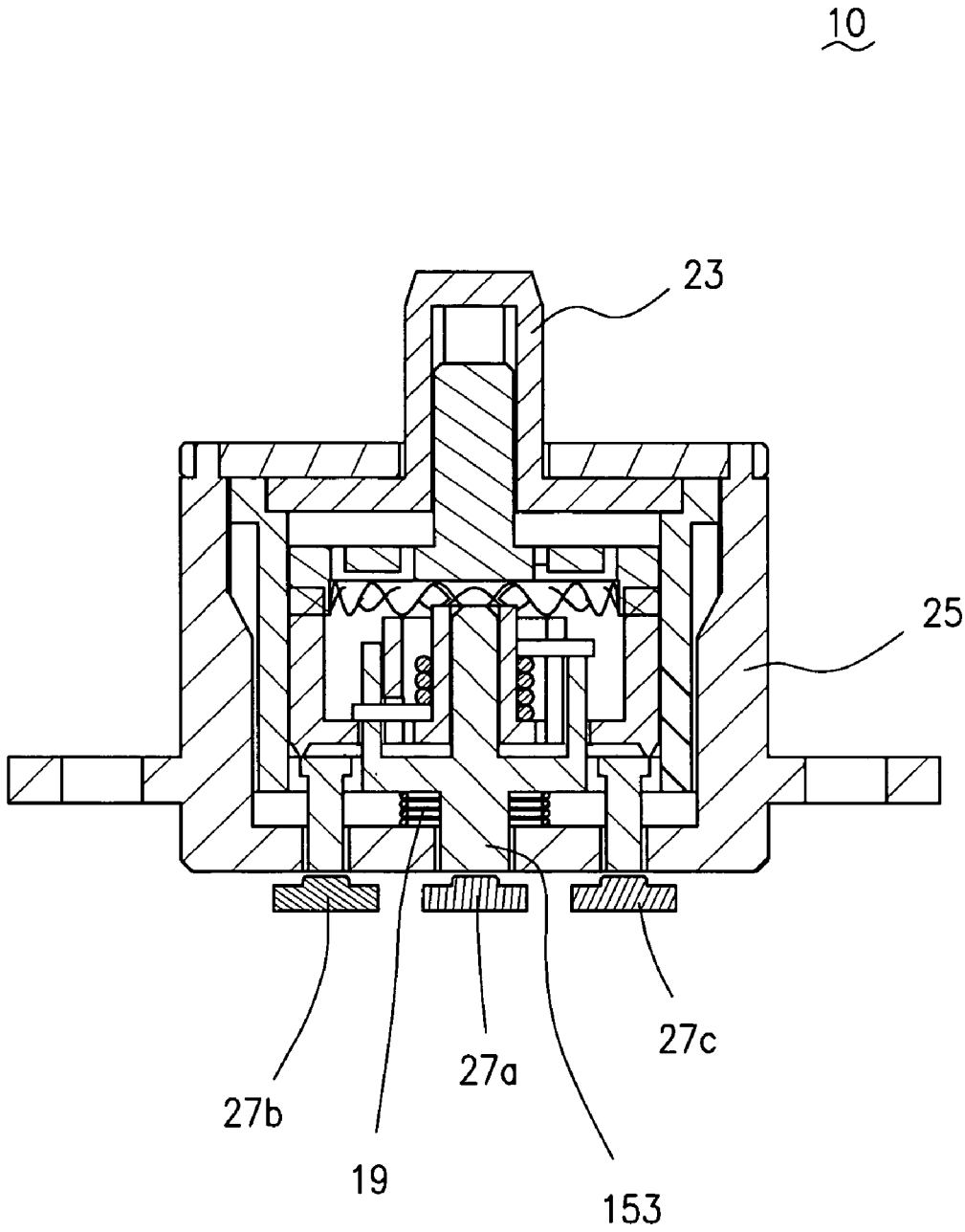
FIG. 8 is an assembled sectional view of the second embodiment of a switch according to the present invention.

Referring to FIG. 8, the spring 19 in the second embodiment is different from that in the first embodiment in that the spring 19 connects with and surrounds the first pressing post 153 with two ends thereof contacting with the base member 11 and the outer sleeve 25. The spring 19 is employed to move the base member 11 and various parts displacing downward with the base member 11 back to their original positions.

While the invention has been described by way of examples and in teens of preferred embodiments, it is to be understood that the invention is not limited thereto. To the contrary, it is intended to cover various modifications and similar arrangements and procedures, and the scope of the appended claims therefore should be according to the broadest interpretation so as to encompass all such modifications and similar arrangements and procedures.

What is claimed is:

1. A switch device, comprising:

a base member with an open end and a closed end wall, being cylindrical, providing an axial post extending from the closed end wall therein and the closed end wall having two opposite circular grooves near the circumference thereof;

a rotary mechanism, being received in the base member for being operated to move a preset circular displacement and further comprising a first ratchet wheel, which is attached with a central stem, a second ratchet wheel, which meshes with the first ratchet wheel and has a bottom with a hole at the center thereof for fitting with the axial post and a plurality of semispherical projections being disposed next to the periphery thereof and spacing from each other, and a torsion spring, which is disposed on the bottom of the second ratchet wheel and surrounds the axial post with an end thereof engaging with the top of the axial post and another end thereof engaging with the second ratchet wheel;

a vertical actuation mechanism, being composed of two elastic plates, which are received in the base member under the second ratchet wheel and movably disposed at the closed end wall corresponding to the two circular grooves with at least one contact point being provided at each of the elastic plates to protrude outward from two facial sides thereof;

a hollow handle, providing a circular plate part, which has a diameter same as the inner diameter of the open end of the base member, and a cylindrical part being fixedly attached to the stem of the first ratchet wheel for being rotated by a user;

a spring, being disposed between the first ratchet wheel and the circular plate part and surrounding the stem part for supplying a resilient force to the handle; and a cover plate, being disposed at the open end of the base member and providing a central bore for being passed through by the handle;

whereby, once the handle is turned by the user to drive the first ratchet wheel rotating a preset circular distance with the second ratchet wheel such that the projections are capable of pushing the contact points downward to press button switches underneath.

2. The switch device as defined in claim 1, wherein an elongated slot is provided at the top of the axial post to accommodate an end of the torsion spring and the second ratchet wheel provides a stopper formed of two parallel rectangular blocks and another end of the torsion is fixedly received in a space between the rectangular blocks.

3. The switch device as defined in claim 1, wherein the second ratchet wheel has two opposite recesses at the periphery of the bottom thereof and the base member provides two limiting ribs at the lower inner side thereof corresponding to the recesses respectively for restricting movement of the second ratchet.

4. A switch device, comprising:

An outer barrel, being cylindrical, providing an open side and a closed side, the closed side having a central fitting hole and two opposite circular side fitting hole and two opposite lugs with an engaging hole being provided at each of the lugs being joined to the lower circumference side thereof for being fixed to an external part;

a base member with an open end and a closed end wall, being cylindrical and received in the outer barrel, providing an axial post extending from the closed end wall therein and a first pressing post extending outward from the center of the closed end wall to pass through the central fitting hole and the closed end wall having two opposite circular grooves near the circumference thereof;

a rotary mechanism, being received in the base member for being operated to move a preset circular displacement and further comprising a first ratchet wheel, which is attached with a central stem, a second ratchet wheel, which meshes with the first ratchet wheel and has a bottom with a hole at the center thereof for fitting with the axial post and a plurality of semispherical projections being disposed next to the periphery thereof and spacing from each other, and a torsion spring, which is disposed on the bottom of the second ratchet wheel and surrounds the axial post with an end thereof engaging with the top of the axial post and another end thereof engaging with the second ratchet wheel;

a vertical actuation mechanism, being composed of two elastic plates, which are received in the base member under the second ratchet wheel and movably disposed at the closed end wall corresponding to the two circular grooves with at least one second pressing post being provided at each of the elastic plates to pass through the circular side fitting holes and extend outward from the outer barrel;

a hollow handle, providing a circular plate part, which has a diameter same as the inner diameter of the open end of the base member, and a cylindrical part being fixedly attached to the stem of the first ratchet wheel for being rotated by a user;

a compression spring, being disposed between the outer barrel and the base member and surrounding the first pressing post for supplying a resilient force to base member; and a cover plate, being disposed at the open end of the base member and providing a central bore for the handle extending outward, whereby, once the handle is turned to move the preset circular displacement by the user, the base member with the ratchet wheels rotates such that the second pressing posts are capable of being pushed downward by the projections so as to press button switches underneath; and in addition, once the handle is pressed down directly, the base member is forced to move downward against the compression spring such that the first pressing post is capable of moving downward to touch a further button switch disposed under the first pressing post.

* * * * *